US011548122B2

(12) United States Patent
Schulz

(10) Patent No.: US 11,548,122 B2
(45) Date of Patent: Jan. 10, 2023

(54) INLINE RATCHETING MECHANISM

(71) Applicant: Snap-on Incorporated, Kenosha, WI (US)

(72) Inventor: Ben T. Schulz, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 232 days.

(21) Appl. No.: 16/859,532

(22) Filed: Apr. 27, 2020

(65) Prior Publication Data

US 2021/0331297 A1 Oct. 28, 2021

(51) Int. Cl.
*B25B 21/00* (2006.01)

(52) U.S. Cl.
CPC ..... *B25B 21/002* (2013.01); *B25B 21/004* (2013.01)

(58) Field of Classification Search
CPC ... B25B 21/002; B25B 21/004; B25B 13/466; B25B 23/1427
See application file for complete search history.

(56) References Cited

U.S. PATENT DOCUMENTS

| | | | | |
|---|---|---|---|---|
| 1,627,441 | A | 5/1927 | Lawyer | |
| 2,292,228 | A | 8/1942 | Krieger | |
| 2,393,413 | A | 1/1946 | Rober | |
| 5,576,501 | A * | 11/1996 | Huang | B25B 13/463 81/473 |
| 5,737,982 | A | 4/1998 | Lin | |
| 5,875,692 | A | 3/1999 | Lin | |
| 6,568,298 | B1 | 5/2003 | Zinck | |
| 7,454,997 | B2 | 11/2008 | Putney et al. | |
| 8,757,035 | B2 | 6/2014 | Kerboul et al. | |
| 2002/0102143 | A1 * | 8/2002 | Huang | B25B 13/466 81/63.1 |
| 2009/0264940 | A1 * | 10/2009 | Beale | A61B 17/8875 606/86 R |
| 2013/0152746 | A1 * | 6/2013 | Kerboul | B25B 23/1427 81/475 |
| 2014/0262394 | A1 * | 9/2014 | Scott | B25B 21/026 173/48 |
| 2014/0338504 | A1 * | 11/2014 | Beer | B25B 23/18 81/57.39 |
| 2017/0282344 | A1 * | 10/2017 | Yin | B25B 21/023 |

FOREIGN PATENT DOCUMENTS

| | | | | |
|---|---|---|---|---|
| CN | 108673397 | A | 10/2018 | |
| CN | 110695901 | A | 1/2020 | |
| DE | 102008032896 | A1 * | 7/2008 | B25B 15/04 |
| DE | 102008032896 | A1 | 1/2010 | |

(Continued)

OTHER PUBLICATIONS

Taiwan Office Action for corresponding TW Application No. 110114847, dated Jan. 27, 2022, 3 pages.

(Continued)

*Primary Examiner* — Andrew M Tecco
*Assistant Examiner* — Nicholas E Igbokwe
(74) *Attorney, Agent, or Firm* — Seyfarth Shaw LLP

(57) ABSTRACT

An inline ratcheting mechanism for motorized hand tools that includes a drive body, a ratchet shaft, ratchet pawls, a reversing collar, and a reversing switch adapted to cause the reversing collar to engage or disengage the ratchet pawls with ratchet teeth of the ratchet shaft.

18 Claims, 2 Drawing Sheets

(56) References Cited

FOREIGN PATENT DOCUMENTS

| | | | |
|---|---|---|---|
| EP | 0230461 | B1 | 4/1992 |
| TW | 144262 | | 10/1990 |
| WO | 2021175253 | A1 | 9/2021 |

OTHER PUBLICATIONS

Combined Search and Examination Report for corresponding Application No. GB2105384.8 dated Oct. 6, 2021, 7 pages.
Canadian Office Action for corresponding Application No. 3,115,686 dated Jul. 27, 2022, 4 pages.
Chinese Office Action for corresponding Application No. 202110438049.5 dated Aug. 2, 2022, 10 pages.

* cited by examiner

INLINE RATCHETING MECHANISM

TECHNICAL FIELD OF THE INVENTION

The present invention relates generally to motorized hand tools for applying torque to a work piece. More particularly, the present invention relates to an inline ratcheting mechanism of a motorized hand tool.

BACKGROUND OF THE INVENTION

Power hand tools, such as motorized ratchet wrenches and drivers, are commonly used in automotive, industrial and household applications to install and remove threaded fasteners and to apply torque and/or angular displacement to a work piece, such as, for example, a threaded fastener. Motorized hand tools, such as power ratchets and drivers, generally include an electric motor contained in a housing along with other components, such as switches, light emitting diodes (LEDs), and a removable battery, for example.

Power ratchets are often used to access a work piece, such as, for example, fasteners, nuts, etc., that is in a tight or hard to reach space, such as, for example, an automobile engine bay. Power ratchets generally include an oscillating-type head driven by an electric motor to actuate a mechanical ratcheting mechanism, thereby transferring torque to a drive unit of the tool and eventually to the work piece. The mechanical ratcheting mechanism also allows the power ratchet to be manually operated as a conventional ratchet, when necessary or desired. The mechanical ratcheting mechanism also includes a reversing mechanism, which includes a lever or switch, is typically located on or near the head of the ratchet and adapted to be actuated to select a direction to drive the work piece. However, the reversing mechanism disposed in the ratchet head requires a large tool head that can be difficult to fit into tight spaces to access a work piece. Further, the lever or switch disposed on the ratchet head increases the possibility that the tool can get stuck in a position where the user is unable to actuate the reversing mechanism.

SUMMARY OF THE INVENTION

The present invention relates broadly to an inline ratcheting mechanism for a motorized hand tool, such as a ratchet type tool. The inline ratcheting mechanism can be disposed proximate to where a user operates the tool, such as a handle or grip portion. This location also allows the reversing mechanism, such as a lever or switch, to be disposed proximate to where the user grips the tool, such as a handle or grip portion, which reduces the possibility of the tool getting stuck in a position where the user is unable to actuate the reversing mechanism. Accordingly, a compact ratchet head is disclosed, since the ratcheting mechanism and/or the reversing mechanism no longer must be disposed in the ratchet head.

In particular, the present invention broadly comprises a tool including a housing assembly and a driver assembly coupled to the housing assembly. The driver assembly includes a lug adapted to drive a work piece, a drive body coupled to a drive body cap, a ratchet shaft disposed in the drive body and including ratchet teeth, first and second ratchet pawls adapted to move axially along the ratchet shaft to selectively engage the ratchet teeth, thereby selecting a rotational drive direction, and a reversing collar adapted to be selectively positioned in either of first and second positions via a reversing switch to cause the first and second ratchet pawls to move axially along the ratchet shaft. When the reversing collar is positioned in the first position, one of the first ratchet pawl engages, and the second ratchet pawl disengages, the ratchet teeth, thereby selecting a first rotational drive direction, and when the reversing collar is positioned in the second position, the first ratchet pawl disengages, and the second ratchet pawl engages, the ratchet teeth, thereby selecting a second rotational drive direction.

In another embodiment, the present invention can further broadly comprise a ratcheting mechanism of a motorized hand tool that includes a drive body cap, a drive body coupled to the drive body cap, a ratchet shaft disposed in the drive body and including ratchet teeth, first and second ratchet pawls adapted to axially move along the ratchet shaft, a reversing collar adapted to axially move the first and second ratchet pawls to selectively engage the ratchet teeth, and a reversing switch adapted to selectively position the reversing collar in either one of first and second positions. When the reversing collar is positioned in the first position, the first ratchet pawl engages, and the second ratchet pawl disengages, the ratchet teeth, thereby selecting a first rotational drive direction, and when the reversing collar is positioned in the second position, the first ratchet pawl disengages, and the second ratchet pawl engages, the ratchet teeth, thereby selecting a second rotational drive direction.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
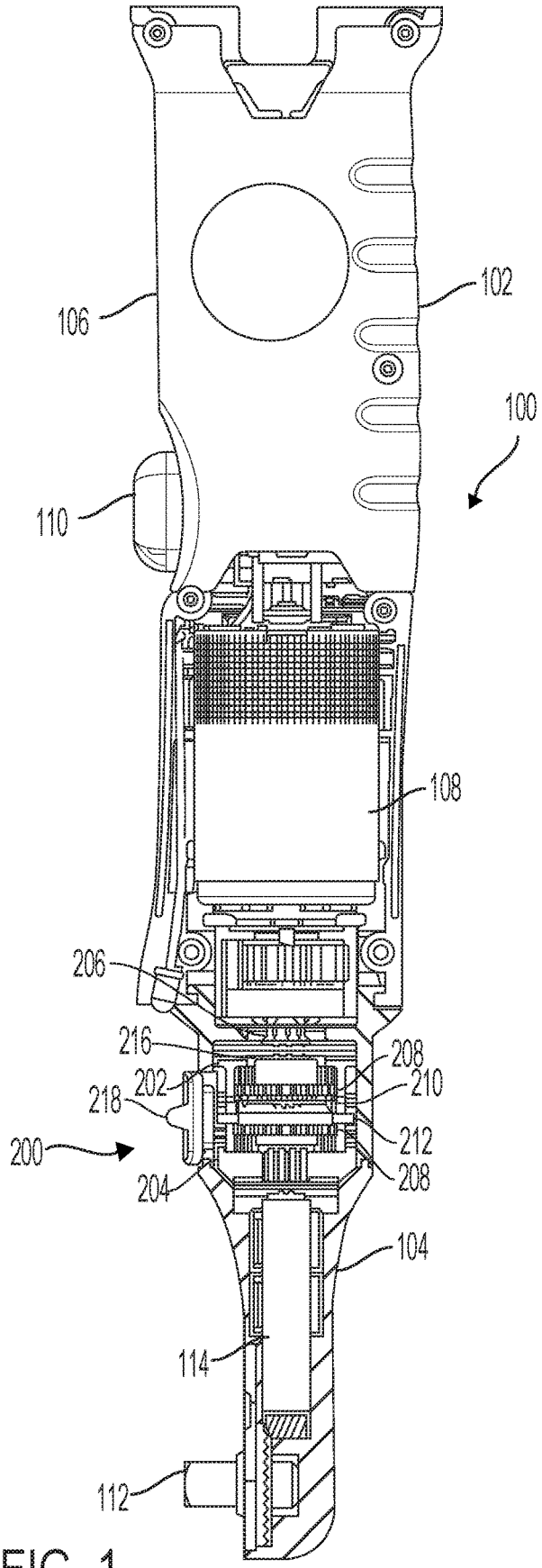
FIG. 1 is a partial broken, side plan view of a front of a tool with a ratcheting mechanism, according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present invention broadly comprises a motorized hand tool, such as a motorized ratchet tool, with a ratcheting mechanism disposed proximate to where a user grips and/or operates the tool. This allows for a compact ratchet head to be used and reduces the possibility of the tool getting stuck in a position where the user is unable to reverse the mechanism. The ratcheting mechanism includes, for example, a drive body, a drive body cap, a ratchet shaft, first and second ratchet pawls, first and second reversing rings, a reversing collar, first and second biasing members, a retaining ring, and a reversing switch.

Figure 2:
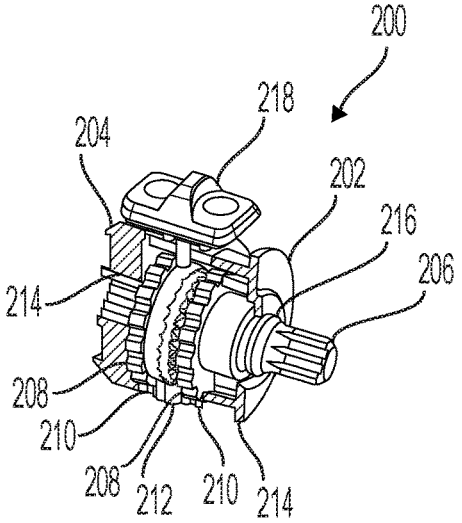
FIG. 2 is a partial broken perspective view of a ratcheting mechanism, according to an embodiment of the present invention.
Figure 3:
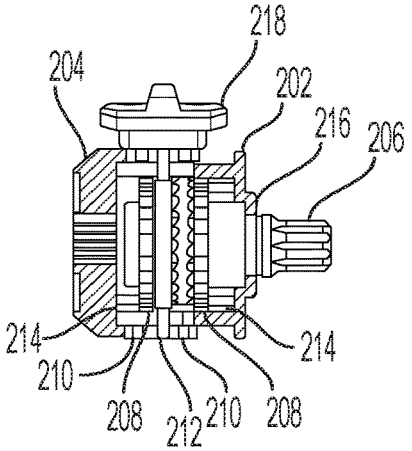
FIG. 3 is a partial broken, side plan view of the ratcheting mechanism of FIG. 2.
Figure 4:
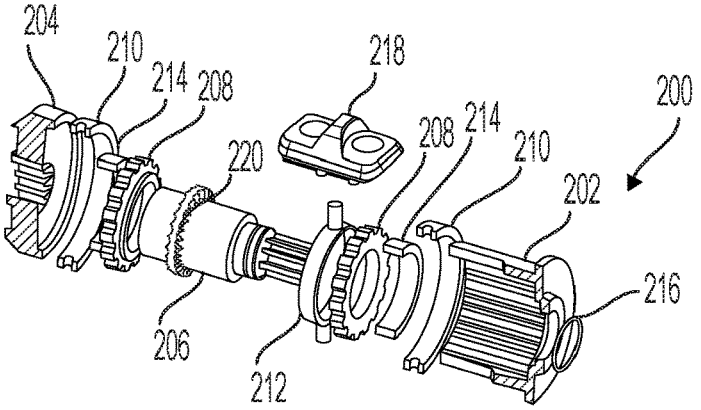
FIG. 4 is a partial broken, disassembled perspective view of the ratcheting mechanism of FIG. 2.
Figure 5:
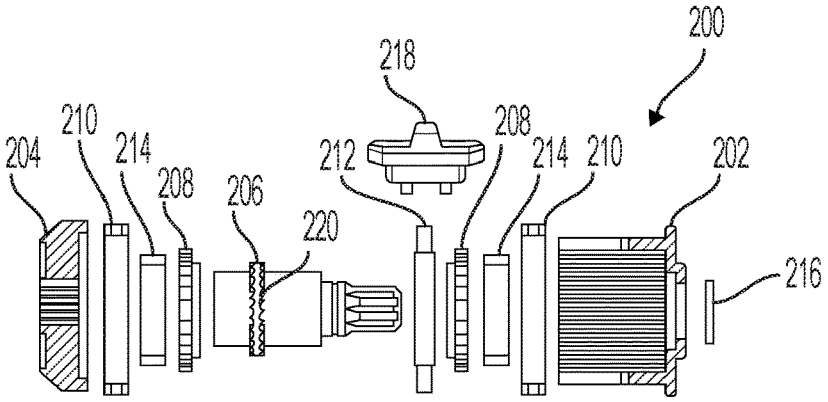
FIG. 5 is a partial broken, disassembled side view of the ratcheting mechanism of FIG. 2.

Referring to FIGS. 1-5, a tool 100, such as a motorized ratchet tool, includes a housing assembly 102 adapted to be held by a user. A driver assembly 104 is coupled to the housing assembly 102. The housing assembly 102 includes a handle portion 106 that a user may grip to operate the tool 100. The housing assembly 102 may be assembled from two or more clamshell portions coupled together. The clamshell portions may be coupled together using fasteners, such as screws or rivets, glued, or welded, for example. The housing assembly 102 encloses one or more of a motor 108, a switch 110, a power source (not shown), and status indicators (not shown), such as light emitting diodes (LED), for example.

The motor 108 can be, for example, an electric motor electrically coupled to the power source via the switch 110. The power source can be external (e.g., an electrical wall outlet) or internal (e.g., a battery). The switch 110 can be adapted to turn the motor 108 ON and OFF and/or change the rotational direction of the output of the motor 108. The switch 110 may include an actuation mechanism that employs a push button actuator or other type of actuator to activate or operate the switch 110. Alternatively, the switch 110 can be a toggle actuator, a touch sensitive actuator, a slide actuator, or other suitable actuator or device.

The driver assembly 104 includes a lug 112 adapted to engage a tool pieces (e.g., a socket or bit), which is adapted to engage and drive a work piece, such as a threaded fastener or nut, for example. The lug 112 is operatively coupled to and driven by the motor 108 via a ratcheting mechanism 200. A compressible member such a steel wave washer or an O-ring (not shown) made from a compressible material such as rubber or other elastomer, for example, may be disposed between the housing assembly 102 and the driver assembly 104 to absorb dimensional tolerances, to provide pressure that facilitates a tight fit and alignment of drive gears, and/or for providing a seal to prevent contamination of water protrusion of internal components, for example.

In an embodiment, the ratcheting mechanism 200 is disposed in the driver assembly 104 and proximate to the housing assembly 102. In another embodiment, the ratcheting mechanism 200 is disposed in the housing assembly 102. The ratcheting mechanism includes a drive body 202, a drive body cap 204, a ratchet shaft 206, first and second ratchet pawls 208, first and second reversing rings 210, a reversing collar 212, first and second biasing members 214, such as for example, springs, a retaining ring 216, and a reversing switch 218.

The reversing switch 218 is coupled to the first and second reversing rings 210, which respectively abut sides of the reversing collar 212. Accordingly, the reversing switch 218 can be actuated to cause the reversing rings 210 to axially move the reversing collar 212 along the ratchet shaft 206 to selectively position the reversing collar 212 in either one of first and second positions. In addition, the reversing switch 218 may also be operably coupled to the motor 108, such as, for example, electrically or mechanically, to control and cause the output of the motor to selectively rotate in either one of first and second directions, such as, for example, clockwise and counter-clockwise directions, thereby selecting either one of first and second rotational drive directions of the tool.

In an embodiment, to drive the lug 112 in the first rotational drive direction, the motor is operably selected to rotate in the first direction, and the reversing collar 212 is disposed in the first position. Likewise, to drive the lug 112 in the second rotational drive direction, the motor 108 is operably selected to rotate in the second direction and the reversing collar 212 is disposed in the second position.

When the reversing collar 212 is moved to the first position, the reversing collar 212 causes the second ratchet pawl 208 to disengage the ratchet teeth 220 of the ratchet shaft 206 and compresses the second biasing member 214. The first ratchet pawl 208 then engages the ratchet teeth 220 of the ratchet shaft 206 via a bias force from the first biasing member 214. When the reversing collar 212 is disposed in the second position, the reversing collar 212 causes the first ratchet pawl 208 to disengage the ratchet teeth 220, and compresses the first biasing member 214. The second ratchet pawl 208 then engages ratchet teeth 220 of the ratchet shaft 206 via a bias force of the second biasing member 214.

The ratchet shaft 206 is retained in the drive body 202 by a retaining ring 216 and is operably coupled at one end to an output of the motor 108. The first and second ratchet pawls 208 have a spline style geometry that corresponds to a splined inner surface of the drive body 202, thereby allowing the first and second ratchet pawls 208 to move in an axial direction along the ratchet shaft 206. Accordingly, the ratchet shaft 206 is selectively coupled to the drive body 202 when the ratchet teeth 220 of the ratchet shaft 206 are engaged to either one of the first and second pawls 208.

The drive body 202 is coupled to the drive body cap 204. The drive body cap 204 is the output of the ratcheting mechanism 200 and can be coupled to a shaft 114 that drives the lug 112 in either one of the first and second rotational drive directions, such as, for example, clockwise and counter-clockwise directions. When the first pawl 208 is engaged with the ratchet teeth 220 of the ratchet shaft 206 (i.e., the reversing collar 212 is disposed the first position) and the output of the motor 108 rotates in the first direction, the lug 112 is driven in the first rotational drive direction and slips (i.e., ratchets) when rotated in the second direction, thereby applying torque to an engaged work piece in the first rotational direction. When the second pawl 208 is engaged with the ratchet teeth 220 of the ratchet shaft 206 (i.e., the reversing collar 212 is disposed the second position) and the output of the motor 108 rotates in the second direction, the lug 112 is driven in the second rotational drive direction and slips (i.e., ratchets) when rotated in the first direction, thereby applying torque to an engaged fastener in the second rotational direction.

As discussed above, the aspects of the present invention are described in terms of a motorized ratchet tool. However, it should be understood that aspects of the present invention could be implanted in other hand tools or implements. For example, and without limitation, the hand tool can be ratchet wrench, open wrench, screw driver, nut driver, or any other tool capable of applying torque to a work piece.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a driver assembly including:

a lug adapted to drive a work piece;

a drive body coupled to a drive body cap;

a ratchet shaft disposed in the drive body and including ratchet teeth;

first and second ratchet pawls adapted to move axially along the ratchet shaft to selectively engage the ratchet teeth; and a reversing collar disposed between the first and second ratchet pawls and adapted to be selectively positioned in either one of first and second positions via a reversing switch, to thereby cause the first and second ratchet pawls to move axially along the ratchet shaft, wherein when the reversing collar is disposed in the first position, the first pawl engages, and the second pawl disengages, the ratchet teeth, and when the reversing collar is disposed in the second position, the first pawl disengages, and the second pawl engages, the ratchet teeth.

2. The tool of claim 1, further comprising one or more of a motor, a switch, and a status indicator.

3. The tool of claim 1, wherein the tool is a motorized ratchet tool.

4. The tool of claim 1, further comprising a housing assembly, wherein the driver assembly is coupled to the housing assembly, and wherein the housing assembly includes a clamshell housing having a first clamshell portion coupled to a second clamshell portion.

5. The tool of claim 4, further comprising a motor coupled to the ratchet shaft and enclosed within the clamshell housing.

6. The tool of claim 1, wherein the driver assembly further includes reversing rings coupled to the reversing switch, wherein when the reversing switch is actuated, the reversing rings cause the reversing collar to axially move along the ratchet shaft to selectively dispose the reversing collar in either one the first and second positions.

7. The tool of claim 1, wherein the driver assembly further includes first and second biasing members, wherein when the reversing collar is disposed in the first position, the reversing collar engages the second ratchet pawl, which compresses the second biasing member, and the first biasing member causes the first ratchet pawl to engage the ratchet teeth, and wherein when the reversing collar is disposed in the second position, the reversing collar engages the first ratchet pawl, which compresses the first biasing member, and the second biasing member causes the second ratchet pawl to engage the ratchet teeth.

8. The tool of claim 7, wherein the first and second biasing members are springs.

9. The tool of claim 1, wherein the ratchet shaft is retained in the drive body by a retaining ring.

10. The tool of claim 1, wherein each of the first and second ratchet pawls has a spline geometry that matingly corresponds to a spline disposed on an inner surface of the drive body.

11. The tool of claim 1 further comprising a shaft coupled to the drive body cap to selectively drive the lug in first and second directions.

12. A ratcheting mechanism for a tool, comprising:

a drive body cap;

a drive body coupled to the drive body cap;

a ratchet shaft disposed in the drive body and including ratchet teeth;

first and second ratchet pawls adapted to axially move along the ratchet shaft;

a reversing collar disposed between the first and second ratchet pawls and adapted to axially move the first and second ratchet pawls to selectively engage the ratchet teeth; and a reversing switch adapted to selectively dispose the reversing collar in either one of first and second positions, wherein when the reversing collar is disposed in the first position, the first pawl engages, and the second pawl disengages, the ratchet teeth, and when the reversing collar is disposed in the second position, the first pawl disengages, and the second ratchet pawl engages, the ratchet teeth.

13. The ratcheting mechanism of claim 12, wherein the ratcheting mechanism is disposed in a housing assembly of the tool.

14. The ratcheting mechanism of claim 12, wherein the ratcheting mechanism is disposed in a drive assembly of the tool.

15. The ratcheting mechanism of claim 12, further comprising reversing rings coupled to the reversing switch, wherein when the reversing switch is actuated, the reversing rings cause the reversing collar to axially move along the ratchet shaft to selectively dispose the reversing collar in either one of the first and second positions.

16. The ratcheting mechanism of claim 12, further comprising first and second biasing members, wherein when the reversing collar is disposed in the first position, the reversing collar engages the second ratchet pawl, which compresses the second biasing member, and the first biasing member applies biasing force to the first ratchet pawl to cause the first ratchet pawl to engage the ratchet teeth, and wherein when the reversing collar is disposed in the second position, the reversing collar engages the first ratchet pawl, which compresses the first biasing member, and the second biasing member applies biasing force to the second ratchet pawl to cause the second ratchet pawl to engage the ratchet teeth.

17. The ratcheting mechanism of claim 12, further comprising a retaining ring adapted to retain the ratchet shaft in the drive body.

18. The ratcheting mechanism of claim 12, wherein each of the first and second ratchet pawls has a spline geometry that matingly corresponds to a spline disposed on an inner surface of the drive body.

* * * * *